US008598109B2

(12) United States Patent
Holzhauer et al.

(10) Patent No.: US 8,598,109 B2
(45) Date of Patent: Dec. 3, 2013

(54) FABRIC SOFTENER

(75) Inventors: Frederick W. Holzhauer, Novato, CA (US); Donald H. Frey, West Hollywood, CA (US)

(73) Assignee: Method Products, Inc., San Francisco, CA (US)

( * ) Notice: Subject to any disclaimer, the term of this patent is extended or adjusted under 35 U.S.C. 154(b) by 183 days.

(21) Appl. No.: 12/881,077

(22) Filed: Sep. 13, 2010

(65) Prior Publication Data

US 2011/0061173 A1 Mar. 17, 2011

Related U.S. Application Data

(60) Provisional application No. 61/241,834, filed on Sep. 11, 2009.

(51) Int. Cl.
*C11D 1/645* (2006.01)

(52) U.S. Cl.
USPC ..... 510/515; 510/527

(58) Field of Classification Search
USPC ..... 510/515, 527
See application file for complete search history.

(56) References Cited

U.S. PATENT DOCUMENTS

| | | | | |
|---|---|---|---|---|
| 6,156,710 | A * | 12/2000 | Sivik et al. | 510/101 |
| 6,268,232 | B1 * | 7/2001 | Skapa et al. | 438/51 |
| 6,820,626 | B1 | 11/2004 | Jonke et al. | |
| 2006/0030514 | A1 * | 2/2006 | Fraser et al. | 510/515 |
| 2006/0172912 | A1 | 8/2006 | Burt et al. | |
| 2008/0242721 | A1 | 10/2008 | Selifonov | |

OTHER PUBLICATIONS http://www.epa.gov/oppt/newchems/pubs/p2awards-archive/p2-awards-2008/p2-2008.htm Jan. 2011.*
"Carechemicals Dehyquart L80," Cognis, www.cognis.com, Jan. 26, 2004, pp. 1-2.
"Carechemicals A-Z Product Catalog," www.cognis.com, Oct. 2005, pp. 1-44.

* cited by examiner

*Primary Examiner* — John Hardee
(74) *Attorney, Agent, or Firm* — Zilka-Kotab, PC

(57) ABSTRACT

A fabric softener formulation according to one embodiment includes 70-80 wt % methyl bis (canola amidoethyl)-2-hydroxyethyl ammonium methyl sulfate; 2-4 wt % dicocoyl-ethyl hydroxyethylmonium CL; >0-12 wt % of a glycol; >0-10 wt % solvent; 0-5 wt % methyl laurate; 0-5 wt % alcohol; and 0-5 wt % fragrance. A fabric softener formulation according to another embodiment includes 20-30 wt % solvent; >0-2 wt % coco methyl ester ethoxylate; >0-3 wt % glycerin; >0-3 wt % dicocoethyl hydroxyethylmonium methosulfate with propylene glycol; 1-5 wt % alcohol; 35-45 wt % methyl bis(canolaamideoethyl)-2-hydroxyethyl ammonium methyl sulfate with propylene glycol; 0-5 wt % fragrance; 0-2 wt % acid; and 20-30 wt % water.

20 Claims, No Drawings

FABRIC SOFTENER

RELATED APPLICATIONS

This application claims priority to U.S. Provisional Patent Applications having Ser. No. 61/241,834, filed Sep. 11, 2009; which is herein incorporated by reference.

SUMMARY

A fabric softener formulation according to one embodiment includes 70-80 wt % methyl bis (canola amidoethyl)-2-hydroxyethyl ammonium methyl sulfate; 2-4 wt % dicocoylethyl hydroxyethylmonium CL; >0-12 wt % of a glycol; >0-10 wt % solvent; 0-5 wt % methyl laurate; 0-5 wt % alcohol; and 0-5 wt % fragrance.

A fabric softener formulation according to another embodiment includes 20-30 wt % solvent; >0-2 wt % coco methyl ester ethoxylate; >0-3 wt % glycerin; >0-3 wt % dicocoethyl hydroxyethylmonium methosulfate with propylene glycol; 1-5 wt % alcohol; 35-45 wt % methyl bis(canolaamideoethyl)-2-hydroxyethyl ammonium methyl sulfate with propylene glycol; 0-5 wt % fragrance; 0-2 wt % acid; and 20-30 wt % water.

Methods of use as well as illustrative packaging details are also disclosed.

Other aspects and embodiments of the present invention will become apparent from the following detailed description, which illustrate by way of example the principles of the invention.

DETAILED DESCRIPTION

Disclosed herein are fabric softener formulations for use in known applications as well as new applications. For example, various possible formulations are useful in laundering applications, etc.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

The term "or" or "and/or" is used as a function word to indicate that two words or expressions are to be taken together or individually. The terms "comprising," "having," "including," and "containing" are to be construed as open-ended terms (i.e., meaning "including, but not limited to"). The endpoints of all ranges directed to the same component or property are inclusive and independently combinable.

In one approach, a fabric softener formulation has the formulation set forth in Table 1. The denotation "wt %" indicates weight percent of the particular ingredient based on a total weight of the formulation.

TABLE 1

| Ingredient | wt % |
|---|---|
| Methyl bis (canola amidoethyl)-2-hydroxyethyl ammonium methyl sulfate or the like | 70-80 |
| Dicocoylethyl Hydroxyethylmonium CL or the like | 2-4 |
| A glycol such as propylene glycol, ethylene glycol, glycerine, or the like | 0-12 |
| Solvent such as ester lactates (e.g., Ethyl Lactate), Glycol Ether (preferably propylene based), a ketal, a modern solvent, or the like | 0-10 |
| Methyl laurate or the like | 0-5 |
| An alcohol such as ethanol 200 proof, isopropyl alcohol, or the like (e.g., alcohols suitable for carrying fragrance and/or adjusting viscosity) | 0-5 |
| Fragrance (single or blend) | 0-5 |

As noted above, the solvent may include a modern solvent, which may be a solvent based on a ketal or other sustainably-sourced material. Moreover, the ketal is preferably not of a type considered a volatile organic compound (VOC), or may be of a type considered a low VOC. Illustrative ketals include those known in the art, as well as glycerol levulinate ketals such as ethyl levulinate glycerol ketal, and those described in U.S. Patent Pub. No. 2008/0242721 to Sergey and which is herein incorporated by reference.

Note that ester lactates must be used in an anhydrous solution, as otherwise they would hydrate.

In a particularly preferred approach, a fabric softener formulation has the formulation set forth in Table 2.

TABLE 2

| Ingredient | wt % |
|---|---|
| Methyl bis (canola amidoethyl)-2-hydroxyethyl ammonium methyl sulfate | 65-85 |
| Dicocoylethyl Hydroxyethylmonium CL | 0-5 |
| Propylene Glycol | 5-10 |
| Ethyl Lactate | 5-10 |
| Methyl Laurate | 0-3 |
| Ethanol 200 proof | 0-3 |
| Fragrance (single or blend) | 1-3 |

In further approaches, a fabric softener formulation may have ingredients present in a wt % selected from either Table 1 or Table 2.

As noted in Tables 1 and 2, particularly preferred embodiments are anhydrous. The absence of water in the formulations has been found to significantly increase the stability of the fabric softener formulations during long term storage. Moreover, the fabric softener formulation may be super concentrated, resulting in lower packaging footprint and costs.

In further embodiments, some quantity of water may be present in the fabric softener formulation. Table 3 illustrates one such embodiment.

TABLE 3

| Ingredient | wt % |
|---|---|
| Solvent such as dipropylene glycol monomethyl ether, esterified levulinate ketal, or the like | 20-30 |
| Coco methyl ester ethoxylate or the like | >0-2 |
| Glycerin or the like | >0-3 |
| Dicocoethyl Hydroxyethylmonium Methosulfate or the like + Propylene Glycol or the like (total, any ratio between 0:1 and 1:0, preferably at some ratio between the endpoints of 0:1 and 1:0) | >0-3 |
| An alcohol such as ethanol 200 proof, isopropyl alcohol, or the like | 1-5 |
| Methyl bis(canolaamideoethyl)-2-hydroxyethyl ammonium methyl sulfate or the like + | 35-45 |

TABLE 3-continued

| Ingredient | wt % |
|---|---|
| propylene glycol or the like (total, any ratio between 0:1 and 1:0, preferably at some ratio between the endpoints of 0:1 and 1:0) | |
| Fragrance oil (single or blend) | 0-5 |
| Deodorizing agent of a type known in the art, such as zinc ricinoleate, cyclodextrins, or the like | 0-2 |
| An acid such as citric acid (preferably anhydrous), lactic acid, tartaric acid, or the like (preferably with low volatility to reduce odors) | 0-2 |
| Water | remainder |

The embodiments disclosed in Tables 1-3 have been surprisingly been found to have excellent fabric softening properties, even when only a small amount is added to a relatively large quantity of external water, as described below. Moreover, the concentrated or super-concentrated nature of the compositions disclosed herein provide secondary benefits over traditional, unconcentrated softeners. Such secondary benefits include reduced energy consumption during fabrication and packaging, reduced packaging needs (e.g., smaller containers), reduced energy required for transport, etc.

In further approaches, a fabric softener formulation may have ingredients selected from any of the Tables in any combination unless otherwise noted, and preferably in the disclosed ranges. Moreover, as alluded to by the lower end of some of the ranges of 0 wt %, some embodiments may not include certain materials. However, in particularly preferred embodiments, the formulation includes all of the listed materials in some concentration. Known methods may be used to manufacture the various embodiments.

Although not critical to its intended use and performance, it is preferred that the fabric softener formulation is environmentally friendly. In particularly preferred embodiments, the fabric softener formulation does not comprise any ingredient that is not environmentally friendly. As used herein, the fabric softener formulation or ingredient thereof is considered to be environmentally friendly if it meets one or more of the following conditions. For example, it is preferred, although not critical, that the fabric softener formulation contains material derived from natural, and/or sustainable (e.g., renewable) sources, and not petroleum. It is also preferred, although not critical, that all the ingredients of the fabric softener formulation can be degraded through biological or natural processes. In one approach, all ingredients and the finished formula is considered readily biodegradable according to the OECD 301F biodegradability standard. It is also preferred, although not critical, that none of the ingredients of the fabric softener formulation are known to appreciably accumulate in the environment and/or in animals.

In one example of use, an amount of the fabric softener formulation is added to a laundry in a standard manner, e.g., directly to the laundry or preferably to a fabric softener receptacle of the washing machine (if present). The fabric softener formulation may be super concentrated, so only a small amount is added to a standard laundry. For example, in a standard laundry having 69 liters of wash water, about 8 ml to about 20 ml of the fabric softener formulation of Tables 1 or 2 may be added to a dedicated dispenser (e.g., a fabric softener reservoir of the washing machine) or directly to the bath during the rinse cycle.

In one embodiment, the present invention provides a water-soluble or water-rupturable capsule encapsulating the present composition. "Water-soluble" or "water-rupturable," as used interchangeably herein describes a capsule which can be dissolved or broken apart upon contacting with sufficient amount of free water to thereby discharge the present composition or expose the present\composition to water in the surrounding environment. The water-soluble capsule can be made from any water-soluble material in a method known to one skilled in the art. By "water-soluble material" it is meant any substance that readily dissolves or ruptures in free water. The water-soluble material can be a polymeric material or non-polymeric material. Examples of suitable water-soluble material include, but are not limited to, polyvinyl alcohol, polyethylene oxide, methyl cellulose, partially hydrolyzed polyvinyl acetate, alginates, gelatin, carageenan, cellulosics, and combinations thereof. The water-soluble material may be used in plasticized form. That is, the water-soluble material may be mixed or treated with plasticizers, such as, for example, glycerin, sorbitol, and the like. Films of polyvinyl alcohol are most preferred. The invention encompasses the use of materials having water solubilities ranging from partial solubility in hot water to complete solubility in cold water. Moreover, to enhance the performance or stability of the water-soluble capsule, it may contain ingredients besides the above-described water-soluble material. Examples of additional ingredients include, but are not limited to, brighteners, builders, activators, enzymes, and the like.

Depending on the intended use and desired performance, the water-soluble capsule can be in any shape or thickness. For example, the capsule can be in a shape of round, oval, rectangular, square, triangle, diamond, or a combination thereof. By "thickness," it is meant to be the length from the inner surface of the capsule to the outer surface of the capsule. In one specific embodiment, the thickness of the capsule is from about 0.5 to about 10 mils. Preferably, the capsule is in the form of a rounded film. The capsule can be transparent, semi-transparent, or opaque. The capsule may also be of any color.

In one embodiment, the present invention includes a container containing one or more capsules as described above.

In another embodiment, the present invention provides a container, such as, e.g., a metered dose container, comprising the present fabric softener formulation. The container may be in any shape or size depending on the intended use and other functional consideration. For example, the container may be in a shape that is space-saving for storage or transportation purpose, or in a shape that can be easily held/grabbed by a consumer for convenience of use, or both.

In one embodiment, the container has an opening and is in such a shape that consumer's hand can easily reach in and take any of the capsules inside the container. In another embodiment, the container is in a shape to serve as a dispenser, and thereby the consumer's hand can easily reach in and take any of the capsules inside the container. In another embodiment, the container is in a shape to serve as a dispenser, and thereby the consumer's hand does not need to reach inside the container for distributing the capsules. In another embodiment of the present invention, the container is in a shape which allows stacking. In one embodiment of the present invention, the container comprises a chamber for each capsule.

In another embodiment, the container comprises a hand pump dispenser for dispensing the aforementioned metered doses. While larger metered doses are provided in some embodiments, preferred metered dose sizes are less than about 42 ml (where "about X ml" means X±0.25 ml), more preferably between about 3 and about 20 ml. In one approach, the fabric softener formulation is added to a volume of external water by pumping a hand pump dispenser no more than 8 times, where the hand pump dispenser dispenses about 4 ml (maximum) or less per pump. In particularly preferred approaches, the hand pump dispenser is pumped no more than 6 times, where the hand pump dispenser dispenses about 4 ml or less per pump. The volume of external water in these approaches is 69 liters, which is the standard water volume used in a washload in a standard washing machine. Those skilled in the art will appreciate that the numbers of pumps can be adjusted based on the volume of fabric softener formulation dispensed per pump and/or for washloads having higher or lower external water volumes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A fabric softener formulation, comprising:

70-80 wt % methyl bis(canola amidoethyl)-2-hydroxyethyl ammonium methyl sulfate;

2-4 wt % dicocoylethyl hydroxyethylmonium-Cl;

>0-12 wt % of a glycol;

>0-10 wt % solvent;

0-5 wt % methyl laurate;

0-5 wt % alcohol; and 0-5 wt % fragrance.

2. The fabric softener formulation of claim 1, wherein the solvent is selected from a group consisting of ethyl lactate, glycol ether, and a ketal.

3. The fabric softener formulation of claim 1, wherein the solvent is a ketal.

4. The fabric softener formulation as recited in claim 3, wherein the ketal is not a volatile organic compound (VOC).

5. The fabric softener formulation of claim 1, which does not comprise any ingredient that is not environmentally friendly.

6. The fabric softener formulation as recited in claim 5, wherein each ingredient in the fabric softener formulation is considered readily biodegradable according to an OECD 301F biodegradability standard.

7. The fabric softener formulation of claim 1, wherein the alcohol is present at >0-5 wt %.

8. The fabric softener formulation of claim 1, wherein the methyl laurate is present at >0-5 wt %.

9. A hand pump dispenser, comprising the fabric softener formulation of claim 1, and a pump for dispensing a metered dose of less than about 4 ml of the fabric softener formulation per pump.

10. The fabric softener formulation as recited in claim 1, which does not comprise any ingredient derived from petroleum.

11. A product comprising:

the fabric softener formulation as recited in claim 1; and a water-soluble capsule, wherein the fabric softener formulation is encapsulated by the water-soluble capsule, wherein the water-soluble capsule comprises one or more materials selected from a group consisting of: polyvinyl alcohol, polyethylene oxide, methyl cellulose, partially hydrolyzed polyvinyl acetate, alginates, gelatin, carageenan, and cellulosics.

12. The product as recited in claim 11, wherein the solvent is a ketal, wherein the ketal is not a volatile organic compound (VOC)

wherein the fabric softener does not comprise any ingredient that is not environmentally friendly, wherein the fabric softener does not comprise any ingredient derived from petroleum, wherein each ingredient in the fabric softener formulation is considered readily biodegradable according to an OECD 301F biodegradability standard, wherein the fabric softener further comprises <4 wt % of water, wherein the alcohol is present at >0-5 wt %, and wherein the methyl laurate is present at >0-5 wt %.

13. A method for softening laundry, comprising:

causing the fabric softener formulation of claim 1 to be added to a volume of external water to form a diluted aqueous composition; and contacting the diluted aqueous fabric softener formulation with laundry to soften the laundry.

14. The method of claim 13, wherein the fabric softener formulation is caused to be added to the volume of external water by pumping a hand pump dispenser no more than 8 times to dispense the fabric softener formulation into a washing machine, wherein the hand pump dispenser dispenses about 4 ml or less per pump.

15. The method of claim 14, wherein the fabric softener formulation is added to the volume of external water by pumping a hand pump dispenser no more than 6 times, wherein the hand pump dispenser dispenses about 3 ml or less per pump.

16. A fabric softener formulation, comprising:

70-80 wt % methyl bis(canola amidoethyl)-2-hydroxyethyl ammonium methyl sulfate;

2-4 wt % dicocoylethyl hydroxyethylmonium-Cl;

>0-12 wt % of a glycol;

>0-10 wt % solvent;

0-5 wt % methyl laurate;

0-5 wt % alcohol; and 0-5 wt % fragrance, wherein the fabric softener is anhydrous.

17. A product, comprising:

the fabric softener formulation as recited in claim 16; and a water-soluble capsule, wherein the fabric softener formulation is encapsulated by the water-soluble capsule, wherein the water-soluble capsule comprises one or more materials selected from a group consisting of: polyvinyl alcohol, polyethylene oxide, methyl cellulose, partially hydrolyzed polyvinyl acetate, alginates, gelatin, carageenan, and cellulosics.

18. The fabric softener formulation of claim 16, wherein the solvent is ethyl lactate.

19. A hand pump dispenser, comprising the fabric softener formulation of claim 16, and a pump for dispensing a metered dose of less than about 4 ml of the fabric softener formulation per pump.

20. The product as recited in claim 17, wherein the solvent is selected from a group consisting of ethyl lactate, glycol ether, and a ketal, wherein the fabric softener does not comprise any ingredient that is not environmentally friendly, wherein the fabric softener does not comprise any ingredient derived from petroleum, wherein each ingredient in the fabric softener formulation is considered readily biodegradable according to an OECD 301F biodegradability standard, wherein the alcohol is present at >0-5 wt %, and wherein the methyl laurate is present at >0-5 wt %.

* * * * *